United States Patent [19]

Whipple

[11] Patent Number: 4,707,039

[45] Date of Patent: Nov. 17, 1987

[54] COAXIAL CONNECTOR FOR CONTROLLED IMPEDANCE TRANSMISSION LINES

[75] Inventor: Charles K. Whipple, Mukilteo, Wash.

[73] Assignee: John Fluke Mfg. Co., Inc., Everett, Wash.

[21] Appl. No.: 20,191

[22] Filed: Feb. 26, 1987

Related U.S. Application Data

[63] Continuation of Ser. No. 846,517, Mar. 31, 1986, abandoned, which is a continuation of Ser. No. 599,077, Apr. 11, 1984, abandoned.

[51] Int. Cl.[4] ..... H01R 13/648; H01R 17/04

[52] U.S. Cl. ..... 439/75; 439/608; 439/581

[58] Field of Search ..... 339/14 R, 17 LM, 17 M, 339/143 R, 177 R, 177 E

[56] References Cited

U.S. PATENT DOCUMENTS

| | | | |
|---|---|---|---|
| 3,155,930 | 11/1964 | Lovejoy | 339/17 T |
| 3,201,722 | 8/1965 | May et al. | 339/17 R |
| 3,218,585 | 11/1965 | May | 339/17 M |
| 3,221,286 | 11/1965 | Fedde | 339/17 F |
| 3,880,486 | 4/1975 | Auakian | 339/17 M |
| 4,482,937 | 11/1984 | Berg | 339/17 LM |
| 4,506,939 | 3/1985 | Faulkenberry et al. | 339/17 M |

FOREIGN PATENT DOCUMENTS

| | | | |
|---|---|---|---|
| 0085816 | 8/1983 | European Pat. Off. | 339/143 R |

*Primary Examiner*—Gil Weidenfeld
*Assistant Examiner*—Gary F. Paumen
*Attorney, Agent, or Firm*—Mikio Ishimaru; Benjamin J. Hauptman

[57] ABSTRACT

The invention comprises first and second wiring carriers surrounded and separated by shielding means, conductive lines on said carriers being electrically joined by means of a projection (pin) and socket. The projection extends coaxially through a hole in the shielding means.

11 Claims, 3 Drawing Figures

COAXIAL CONNECTOR FOR CONTROLLED IMPEDANCE TRANSMISSION LINES

This application is a continuation of Ser. No. 846,517, filed Mar. 31, 1986, now abandoned, which is a continuation of Ser. No. 599,077, filed Apr. 11, 1984, now abandoned.

FIELD OF THE INVENTION

The present invention relates generally to wiring board connectors and more particularly to a connector which is used to interconnect a plurality of wiring boards where a conductive housing separates the wiring boards for shielding purposes and it is desirable to maintain the radio frequency impedance constant from one wiring board through the housing to another wiring board.

BACKGROUND OF THE INVENTION

In the past, many different methods of interconnecting wiring boards have been developed. They have all tended to be complex and expensive but they provided an acceptable controlled radio frequency impedance transmission line for the then existing level of technology. Thus, there have been few new developments in this art.

In the past, there have been connectors such as those developed by G. A. Fedde, U.S. Pat. No. 3,221,286, granted Nov. 30, 1965. In this patent there are actually four separate boards involved which requires the connector to be a series of controlled impedance transmission lines, called strip lines, each on its own base. Each end of the connector is clamped between two of the boards and the impedance and transmission characteristics of the connector are controlled by adjusting the thickness of the connector base material. This invention provides no radio frequency shielding between the various wiring boards and is cumbersome and costly to implement.

Another type of connector was disclosed by C. B. May, U.S. Pat. No. 3,218,585, granted Nov. 16, 1965. The May patent shows a complex machined piece which in effect places a transmission line between two dielectrics in order to effectively form a waveguide between two parallel wiring boards. Essentially, six closely machined pieces are required to provide both the carrier of the strip conductor as well as the clamping mechanism for clamping the strip between the two wiring boards plus a closely toleranced dielectric material to carry the flat strip conductor. All this contributes to a very expensive connector.

In most other situations in the prior art, the attempt has been made to connect a strip line to a coaxial line which means to connect to another strip line requires a second similar coaxial line to strip line connector. All this adds cost. An example of this is shown by H. E. Lovejoy, U.S. Pat. No. 3,155,930, granted Nov. 3, 1964 and a simpler device is disclosed by C. B. May et al., U.S. Pat. No. 3,201,722, granted Aug. 17, 1965. This approach has also been used by the assignee of the present invention.

With these prior art connectors, the wiring boards are not easily connected and disconnected for installation and servicing purposes.

Heretofore, the best connector between controlled impedance transmission lines has been that developed and used by the assignee of the present invention and described as Prior Art. To allow appreciation of this Prior Art, it is discussed infra. in the Description of the Preferred Embodiment.

SUMMARY OF THE INVENTION

The present invention provides apparatus for making direct coaxial transitions between controlled impedance transmission lines, such as strip lines or microstrips, on separate wiring boards.

The present invention further provides an easily connected and disconnected connector.

The present invention further provides a connector wherein the conductor diameter is matched with the dielectric diameter to obtain a desired characteristic impedance.

The present invention further provides a connector providing excellent radio frequency shielding characteristics between wiring boards separated by radio frequency shields.

The present invention further provides a connector having good voltage standing wave ratios (VSFR) at high frequencies.

The present invention further provides a low-cost, compact connector.

The present invention further provides a coaxial connector which does not require a solid dielectric material and thus avoids the transmission loss associated with most solid dielectric materials.

The above and additional advantages of the present invention will become apparent to those skilled in the art from a reading of the following detailed description when taken in conjunction with the accompanying drawings.

DESCRIPTION OF THE PREFERRED EMBODIMENT

Figure 1:
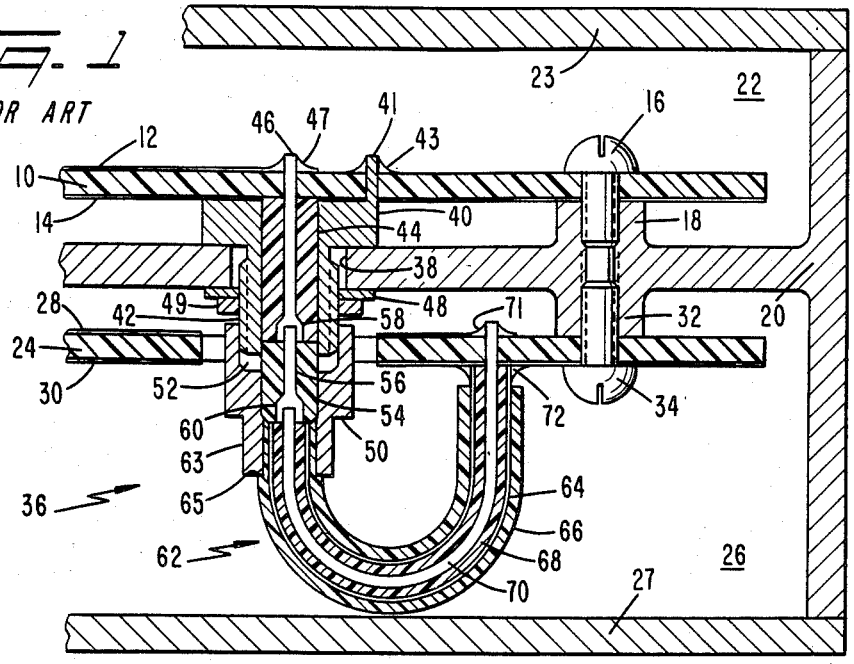
FIG. 1 PRIOR ART
FIG. 1 is a sectional view of a microstrip to microstrip connector of the type currently known in the art.

Referring now to FIG. 1, therein is shown the Prior Art device with a first wiring board 10 having a controlled impedance transmission line of the type referred to as a microstrip and designated as first microstrip 12, provided thereon on one side and a ground plane 14 provided on the other. The first wiring board 10 is secured by a screw 16 to a boss 18 on a conductive housing 20.

The first wiring board 10 is disposed in a first opening 22 of the housing 20 and covered by a conductive cover 23. A second wiring board 24 is disposed in a second opening 26 of the housing 20 and covered by a conductive cover 27.

The second wiring board 24 has provided thereon a second microstrip 28 on one side and a ground plane 30 on the opposite side thereof. The second circuit board is held against a boss 32 of the housing 20 by a screw 34.

The microstrips 12 and 28, are connected by a microstrip to microstrip connector 36 which extends between the first and second openings 22 and 26, respectively, via a through-hole 38.

The microstrip to microstrip connector 36 consists of three main parts. The first part is a female connector 40 having a male thread at one end 42. The female connector 40 is secured to the first wiring board 10 by pins 41 (only one shown) which extend through the wiring board 10 and are held in place by solder joint 43. It contains a cylindrical dielectric 44 which coaxially surrounds a conductor 46 which extends through the first wiring board 10 and is soldered at solder joint 47 to the first microstrip 12. The first wiring board 10 is held to the housing 20 by means of a lockwasher 48 and nut 49 which is screwed onto the male thread 42 to make the female connector 40 act as a holding bolt.

The second part is a male cable connector 50 having a female thread 52 in which the male thread 42 of the female connector 40 is threaded. The male cable connector 50 contains a dielectric 54 which coaxially surrounds conductor 56 which extends into a cup 58 of the connector 46. The connector 56 itself has a cup 60.

The third portion of the microstrip to microstrip connector 36 is a coaxial cable 62 which is inserted into a stem portion 63 of the female cable connector 50 which contains barbs 65. The coaxial cable 62 contains a coaxial cylindrical ground conductor 64 which is contained between coaxial, cylindrical inner and outer dielectrics 66 and 68, respectively, which further encircle a coaxial cable conductor 70.

The coaxial cable 62 is assembled with the male cable connector 50 by being inserted in the stem 63 and having the stem 63 crimped around one end of the coaxial cable 62 so as to have barbs 65 pierce the outer dielectric 66 and conductively contact the ground conductor 64. In the assembled condition, the cable conductor 70 is engaged with the cup 60 of the female cable connector 50.

The end of the conductor 70 opposite the male connector 50 extends through the second wiring board 24, and is conductively connected at solder joint 71 to the second microstrip 28. The ground conductor 64 in the coaxial cable 62 is connected to the ground plane 30 on the second wiring board 24 by solder joint 72. The ground plane 14 is connected by the female connector 40 to the male connector 50 which has barbs 65 engaging the ground conductor 64 which in turn is conductively connected to the ground plane 30 via the solder joint 72.

As is evident, this Prior Art microstrip to microstrip connector 36 is exceedingly complex and therefore expensive. Further, there are many steps in assembly required which result in additional expense. Further, the dielectric material tends to be expensive and there are a large number of manufacturing steps involved in the manufacturing of the microstrip to microstrip connector 36.

Figure 2:
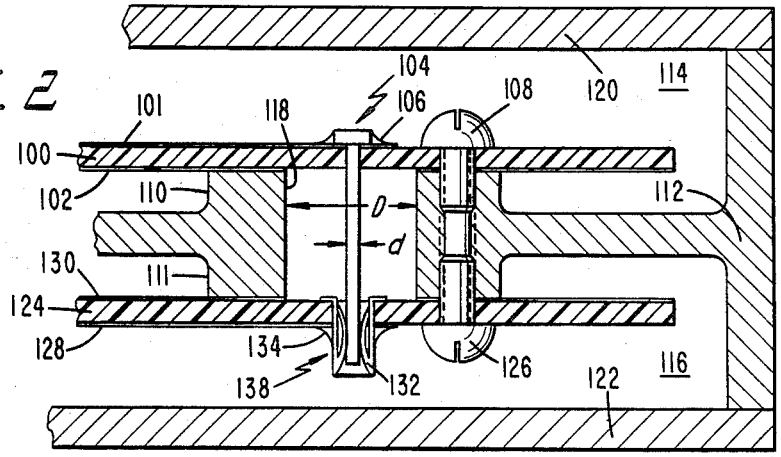
FIG. 2 is a sectional view of a microstrip to microstrip connector designed in accordance with a preferred embodiment of the present invention.

Referring now to FIG. 2 therein is shown a first wiring board 100 having a first microstrip 101 on one side and a ground plane 102 on the other. The first wiring board 100 carries a pin 104 extending therethrough which is conductively connected by solder 106 to the first microstrip 101 and which has a diameter "d".

The first wiring board 100 is connected by a screw 108 to provide good ground to a boss 110 which is part of a housing 112. The housing 112 has a first opening 114 and a second opening 116 into which a boss 111 extends. The first and second openings 114 and 116 are connected by a through hole 118 having a diameter of "D" which extends through the boss 110.

The ratio of the diameter of the hole 118 to the diameter of the pin 104 is substantially:

$$D/d = e^x \text{ wherein } x = (Z_0\sqrt{\epsilon}/59.9);$$

where:

D = the diameter of said hole;

d = diameter of said pin;

$Z_0$ = radio frequency impedance in ohms; and $\epsilon$ = dielectric constant of the material disposed between said pin and said hole.

The above equation is derived in "Reference Data for Radio Engineers", 4th Edition, 12th Printing, p. 589, American Book—Stratford Press, Inc., N.Y., N.Y., March 1967, for a general coaxial cable.

The first and second openings are covered by conductive housing covers 120 and 122, respectively.

A second wiring board 124 is disposed in the second opening 116 and is secured by a screw 126 to the boss 111. The second wiring board has a second microstrip 128 on one side and a ground plane 130 on the other.

The second wiring board 124 carries a spring connector 132 which is conductively connected to the second microstrip 128 by solder 134. The spring connector 132 slidingly engages the pin 104 to conductively connect the first and second microstrips 101 and 128, respectively.

Thus, a microstrip to microstrip connector 138 is shown consisting essentially of the pin 104 and the spring connector 132. It should be noted that the spring connector 132 may be of any conventional design manufactured by a number of electrical connector manufacturers.

In the preferred embodiment, the desired characteristic impedance of the microstrip to microstrip connector 138 is achieved by virtue of controlling the diametral ratio of "d" to "D" and using air as a dielectric. In the preferred embodiment, this characteristic impedance is 50 ohms. If space is not a problem a polymer dielectric could be inserted in the through-hole 118 so the dielectric constant would be higher and the diameter "D" could be made larger. The actual impedance is controlled by the ratio of "d" to "D" and either may be changed.

Excellent radio frequency isolation shielding is obtained between the two wiring boards by virtue of having the two boards enclosed in the two separate openings in the housing 112 and the ground plane 102 of the first wiring board 100 in conductive contact with the housing 112 and the ground plane 130 of the second wiring board 124. With the two ground planes disposed between the microstrips 101 and 128, excellent radio frequency isolation shielding is achieved.

Figure 3:
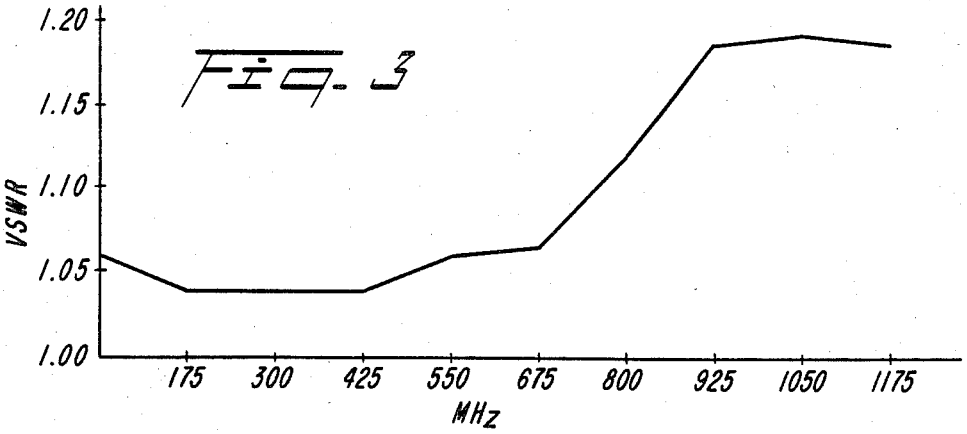
FIG. 3 is a graph depicting the voltage standing wave ratio characteristic versus frequency of the present invention.

Referring now to FIG. 3, therein is shown the voltage standing wave ratio (VSWR) versus frequency (MHZ) characteristic of the present invention. By virtue of experimentation it has been determined that the present conductor has excellent VSMR characteristics.

As would be evident to those skilled in the art, the present invention may easily be installed and removed for servicing or replacement of either wiring board. Further, due to its simplicity, it is extremely economical.

As would also be evident to those skilled in the art, controlled impedance transmission lines include strip lines and most other wiring board conductors in addition to microstrips.

As many possible embodiments may be made of the present invention without departing from the scope thereof, it is to be understood that all matters set forth herein or shown in the accompanying drawings is to be interpreted in an illustrative and not a limiting sense.

I claim:

1. A controlled radio frequency impedance connector comprising:

a conductive radio frequency shield having a hole provided therein of a predetermined constant diameter D;

a first wiring carrier, a first controlled impedance transmission line disposed on one side of said first wiring carrier, a ground plane on the opposite side of said first wiring carrier in electrical contact with said radio frequency shield;

a conductive pin of a predetermined diameter d, wherein $D>d$, extending from said first wiring carrier perpendicular thereto and in conductive contact with said first controlled impedance transmission line, said projection extending through said hole and encircled by said shield, said pin coaxial within said hole and surrounded by an air space to establish with said radio frequency shield a coaxial RF connector, whereby said pin is electrically insulated from said shield and the radio frequency impedance of said connector is determined by D/d;

a second wiring carrier having a second controlled impedance transmission line disposed on one side of said second wiring carrier, a ground plane on the opposite side of said first wiring carrier in electrical contact with said radio frequency shield;

engagement means disposed on said second wiring carrier and in conductive contact with said second controlled impedance transmission line, said engagement means engageable with said pin to conductively connect together said first and second controlled impedance transmission lines; and means for securing together said first and second wiring carriers on opposite sides of said radio frequency shield to establish a good electrical contact between said shield and said first and second ground planes.

2. The connector as claimed in claim 1 including means for attaching said first and second wiring boards to said radio frequency shield proximate said projection, and wherein said first wiring carrier includes a ground area thereon in conductive contact with said radio frequency shield and said second wiring carrier includes a ground area thereon in conductive contact with said radio frequency shield whereby said ground areas on said first and second wiring carrier are in conductive contact.

3. The connector as claimed in claim 2 wherein said radio frequency shield has planar portions and has raised portions extending therefrom with said hole extending through said raised portions perpendicular to said planar portion, said raised portions spacing said first and second wiring carriers from said planar portion and conductively connecting said ground planes to said radio frequency shield.

4. The connector as claimed in claim 1 wherein the ratio of the diameters of said hole to said projection is substantially:

$$D/d=e^x \text{ where } x=(Z_0\sqrt{\epsilon}/59.9)$$

Where:

D=the diameter of said hole;

d=diameter of said projection;

$Z_0$=a predetermined radio frequency impedance; and $\epsilon$=dielectric constant of the matter disposed in said hole between said projection and said hole.

5. A coaxial microstrip to microstrip connector comprising:

a grounded housing having first and second openings provided therein, said housing having a circular hole provided therein having a predetermined diameter D and connecting said first and second openings;

a first wiring board having a ground plane thereon and a microstrip thereon, said first wiring board having a pin of a predetermined diameter d, wherein $D>d$, secured therethrough and conductively connected to said microstrip, said first wiring board disposed in said first opening with said ground plane engaging and conductively contacting said grounded housing and said pin extending through said hole with said predetermined diameter D of said hole coaxial with and substantially coextensive said predetermined diameter d of said pin; and a second wiring board having a ground plane thereon and a microstrip thereon, said second wiring board having a pin connector therein conductively connected to said microstrip thereon, said second wiring board disposed in said second opening with said ground plane thereof engaging and conductively contacting said grounded housing and said pin connector slidably engaging said pin.

6. The connector as claimed in claim 5 including screws for attaching said first and second wiring boards to said conductive housing proximate said pin to conductively ground said ground planes proximate to said pin whereby radio frequency interference between said microstrips is substantially eliminated.

7. The connector as claimed in claim 5 wherein said conductive housing has planar portions and has a raised boss extending therefrom with said hole extending through said boss perpendicular to said planar portion, said boss spacing said first and second wiring boards from said planar portion and connectively connecting said ground planes to said conductive housing.

8. The connector as claimed in claim 5 wherein the ratio of the diameter of said hole to said pin is substantially:

$$D/d=e^x \text{ where } x=(Z_0\sqrt{\epsilon}/59.9)$$

where:

D=the diameter of said hole;

d=diameter of said pin;

$Z_0$=radio frequency impedance of approximately 50 ohms; and $\epsilon$=dielectric constant of 1.0 for air disposed between said pin and said hole.

9. A connector comprising:

a conductive radio frequency shield having a hole provided therein of a predetermined cross section;

a first wiring carrier having a first controlled impedance transmission line thereon disposed on one side of said radio frequency shield and engaged therewith;

a conductive projection of said predetermined cross section extending from said first wiring carrier perpendicular thereto and in conductive contact with said first controlled impedance transmission line, said projection extending through said hole and encircled thereby, said projection within said hole being equispaced from surfaces of said hole and coaxial with said hole to establish with said radio frequency shield a coaxial RF connector, whereby said projection is conductively isolated from said shield;

a second wiring carrier having a second controlled impedance transmission line thereon, said second wiring carrier disposed on the opposite side of said radio frequency shield from said first wiring carrier; and engagement means disposed on said second wiring carrier and in conductive contact with said second controlled impedance transmission line, said engagement means engageable with said projection to conductively connect said first and second controlled impedance transmission lines.

10. A coaxial microstrip to microstrip connector comprising:

a grounded housing having first and second openings provided therein, said housing having a hole provided therein having a predetermined cross section and connecting said first and second openings;

a first wiring board having a ground plane thereon and a microstrip thereon, said first wiring board having a pin of said predetermined cross section secured therethrough and conductively connected to said microstrip, said first wiring board disposed in said first opening with said ground plane engaging and conductively contacting said grounded housing and said pin extending through said hole with said predetermined cross section of said hole defining surfaces coaxial with and substantially coextensive with said predetermined cross section of said pin; and a second wiring board having a ground plane thereon and a microstrip thereon, said second wiring board having a pin connector therein conductively connected to said microstrip thereon, said second wiring board disposed in said second opening with said ground plane thereof engaging and conductively contacting said grounded housing and said pin connector slidably engaging said pin.

11. A connector comprising:

a conductive radio frequency shield having a hole provided therein of a predetermined cross section;

a first wiring carrier having a first controlled impedance transmission line thereon disposed on one side of said radio frequency shield and engaged therewith;

a conductive projection extending from said first wiring board perpendicular thereto and in conductive contact with said first controlled impedance transmission line, said projection extending through said hole and encircled by said hole along substantially all of the extension thereof, said projection having a predetermined cross section smaller than said predetermined diameter of said hole in said radio frequency shield whereby said projection is conductively isolated from said shield;

a second wiring carrier having a second controlled impedance transmission line thereon, said second wiring carrier disposed on the opposite side of said radio frequency shield from said first wiring carrier; and engagement means disposed on said second wiring carrier and in conductive contact with said second controlled impedance transmission line, said engagement means engageable with said projection to conductively connect said first and second controlled impedance transmission lines.

* * * * *